US005924479A

United States Patent [19]

Egbert

[11] Patent Number: 5,924,479

[45] Date of Patent: Jul. 20, 1999

[54] HEAT EXCHANGER WITH HEAT-PIPE AMPLIFIER

[76] Inventor: Mark A. Egbert, 18 Orchard Pl., Bernville, Pa. 19506-9587

[21] Appl. No.: 09/185,065

[22] Filed: Nov. 3, 1998

[51] Int. Cl.[6] ..... F28D 15/00

[52] U.S. Cl. ..... 165/104.14; 165/154

[58] Field of Search ..... 165/104.14, 104.21, 165/104.26, 154

[56] References Cited

U.S. PATENT DOCUMENTS

| | | | |
|---|---|---|---|
| 3,640,090 | 2/1972 | Ares | 165/104.21 |
| 4,161,212 | 7/1979 | Hightower | 165/154 X |
| 4,875,522 | 10/1989 | Noda et al. | 165/104.14 |
| 4,909,316 | 3/1990 | Kamei et al. | 165/104.14 X |
| 5,219,020 | 6/1993 | Akachi | 165/104.14 X |
| 5,511,384 | 4/1996 | Likitcheva | 165/154 X |

*Primary Examiner*—Christopher Atkinson
*Attorney, Agent, or Firm*—Daniel Kramer

[57] ABSTRACT

A heat transfer coil for exchanging heat between a primary fluid and a secondary fluid. The coil has a series of substantially parallel tubing runs. The primary fluid flows within the primary tubing. The secondary fluid flows outside the primary tubing and in contact with it. A heat pipe having a length has a first portion residing within a primary tube and a second portion residing outside the primary tube but adjacent and parallel to it. The secondary fluid thereby exchanges heat with the primary fluid both through the primary tube and through the heat pipe.

8 Claims, 5 Drawing Sheets

SECTION A–A

SECTION A–A

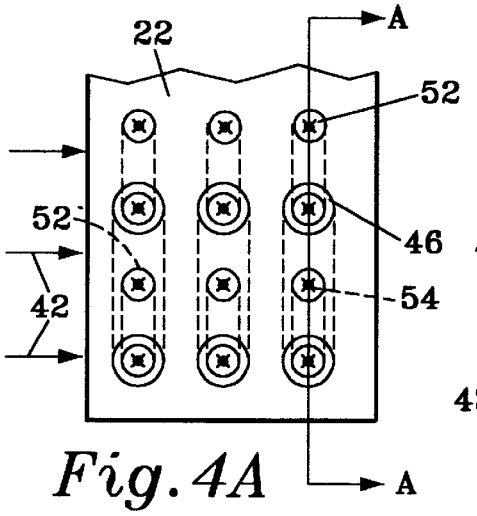
Fig. 4A
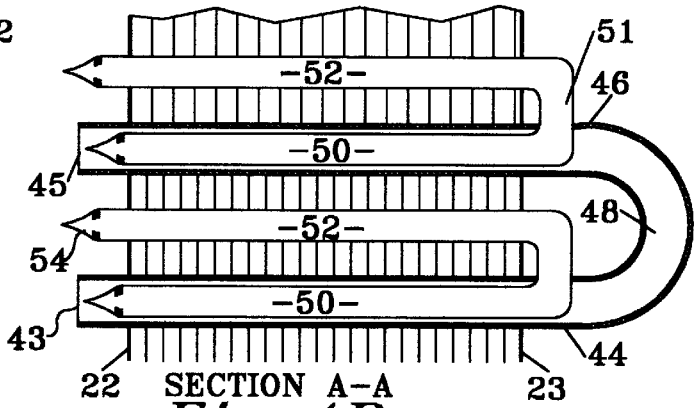
Fig. 4B
Fig. 5A
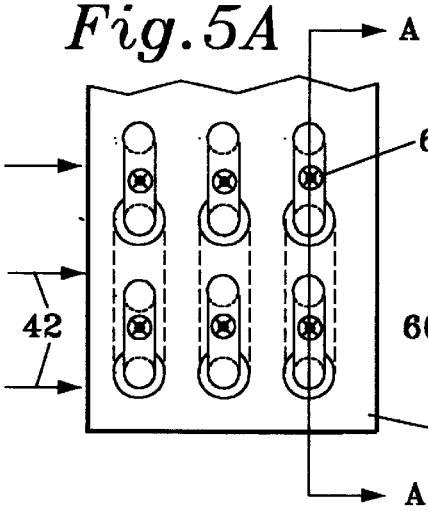
Fig. 5B
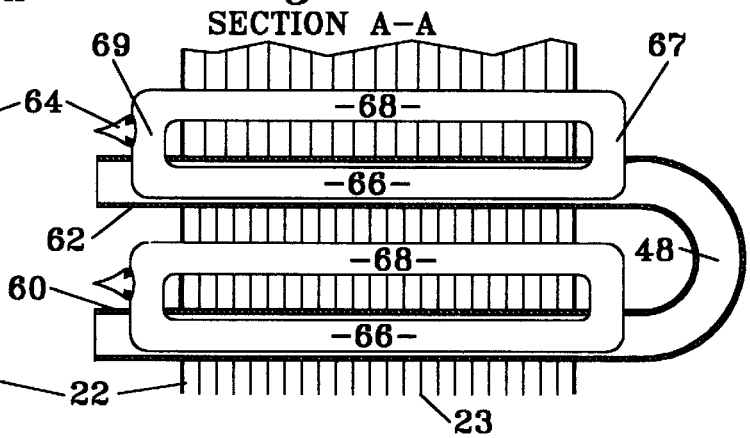

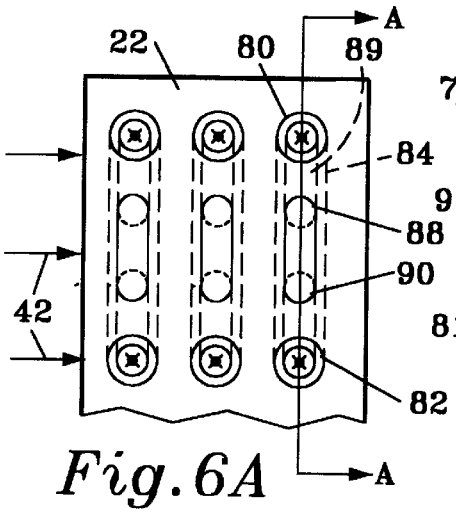
Fig. 6A
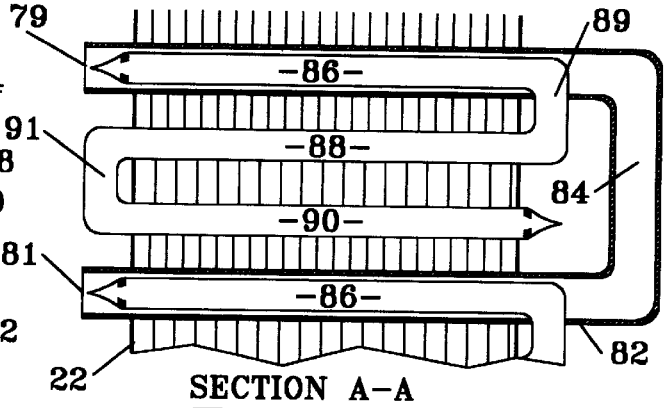
Fig. 6B
Fig. 7A
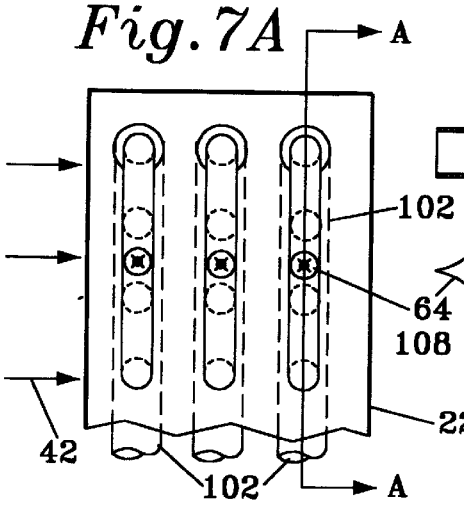
Fig. 7B
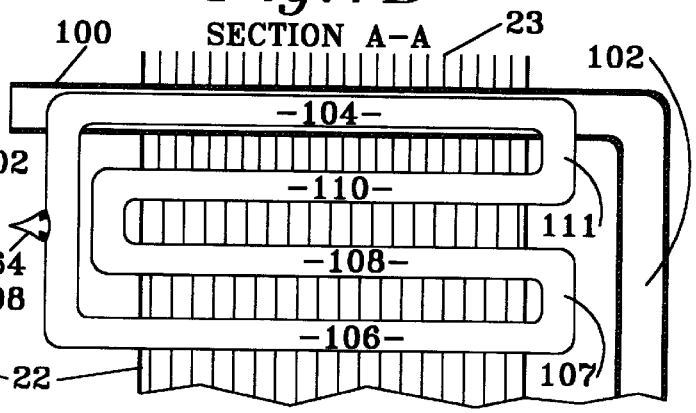

HEAT EXCHANGER WITH HEAT-PIPE AMPLIFIER

BACKGROUND

Related Applications: None

FIELD OF THE INVENTION

This invention is directed to devices which are designed to transfer heat from one fluid to another fluid.

More specifically, the invention is directed to such heat transfer surfaces which employ refrigerant as a primary heat transfer fluid and which have a primary surface interface between the refrigerant and a second medium such as air.

The invention is directed to such heat transfer surfaces where it is desired to minimize the refrigerant charge for reasons of cost and environment protection through reducing the amount of system refrigerant that can be lost through leaks or mistake.

The invention is directed to such heat exchangers where the effectiveness of the primary surface for heat exchange is extended without the addition of leakable system refrigerant charge by the use of heat pipes having thermal communication both with the primary refrigerant circuit and with the second fluid as secondary heat transfer (heat pipe) circuits.

The invention is further directed to such heat exchangers which include extended surfaces such as fins for increasing the effectiveness of either the primary refrigerant circuit, the secondary heat pipe circuit or both.

The invention is further directed to such heat exchangers where the primary refrigerant circuits and the secondary heat pipe circuits are embedded within the same or adjacent fin pack.

PRIOR ART

Heat pipes have been employed in finned heat transfer coils to transfer heat from a first fluid stream to a second fluid stream. (Ares Patent 3,640,090: Feb. 8, '72, See Information Disclosure Document) The use of heat pipes to transfer heat between fluid streams at different temperatures is well known. The Ares patent is simply an example of a well-known use. It does not suggest any direct thermal communication between a heat pipe and any primary refrigerant circuit. Further, applicant is unaware of the use of heat pipes to transfer heat to or from a primary refrigerant within the same or adjacent fin pack.

OBJECTS AND ADVANTAGES

The amount of refrigerant charge in refrigeration systems has become an important design factor. There are at least four reasons for a design engineer to minimize refrigerant charge.

FIRST: To reduce cost. Modern refrigerants now cost ten to twenty times as much as formerly.

SECOND: To reduce cost exposure from possible refrigerant loss. Volatile, pressurized refrigerants can easily disappear into the atmosphere on the occurrence of even a small leak, thereby requiring costly replacement. Further, loss of some refrigerants may require reports to the Environmental Protection Agency (EPA) which could lead to subsequent EPA investigation.

THIRD: To reduce environmental risk. Though modern fluorocarbon refrigerants are believed to pose no risk to the stratospheric ozone, they exert a very substantial global warming effect.

FOURTH: To increase system suitability for hydrocarbon refrigerants. Underwriters Laboratories and others are vigorously exploring ways to safely employ flammable refrigerants in residential, commercial and industrial applications. Rule for application of such refrigerants, so far, all require the refrigerant charges to be minimized. A farsighted design plan for refrigeration systems will envision substitution of flammable refrigerants for CFC type and even for fluorocarbon type refrigerants.

Therefore it is a primary object of my invention is to provide heat exchangers for refrigeration systems which reduce the leakable refrigerant charge in the systems.

A further objective is to provide such heat exchangers which provide high heat transfer efficiency coupled with low refrigerant charge.

It is a further object to reduce the cost of refrigeration evaporators and condensers having minimum refrigerant charge.

Other objects and advantages will become apparent as the construction and application of the novel heat exchangers is described.

BRIEF DESCRIPTION OF THE DRAWINGS

FIGS. 4A and 4B and FIGS. 5A and 5B are similar to the structures shown in FIGS. 2A,B and 3A,B except for the relative orientation of the active and passive portions of the heat pipe.

FIGS. 6A and 6B illustrate a finned coil with two passive coil passes for each active coil pass.

FIGS. 7A and B show a coil having multiple passive passes where the heat pipe is formed into a continuous loop for improved heat transfer effectiveness.

SUMMARY OF THE INVENTION

A heat transfer device for exchanging heat between a refrigerant and a fluid, said device having a primary tube traverse through which the refrigerant passes for direct heat exchange with the fluid and a secondary heat pipe traverse having a portion thereof in thermal contact with the primary tube traverse and a portion thereof in indirect or direct thermal contact with the fluid.

DETAILED DESCRIPTION OF THE INVENTION

Figure 1:
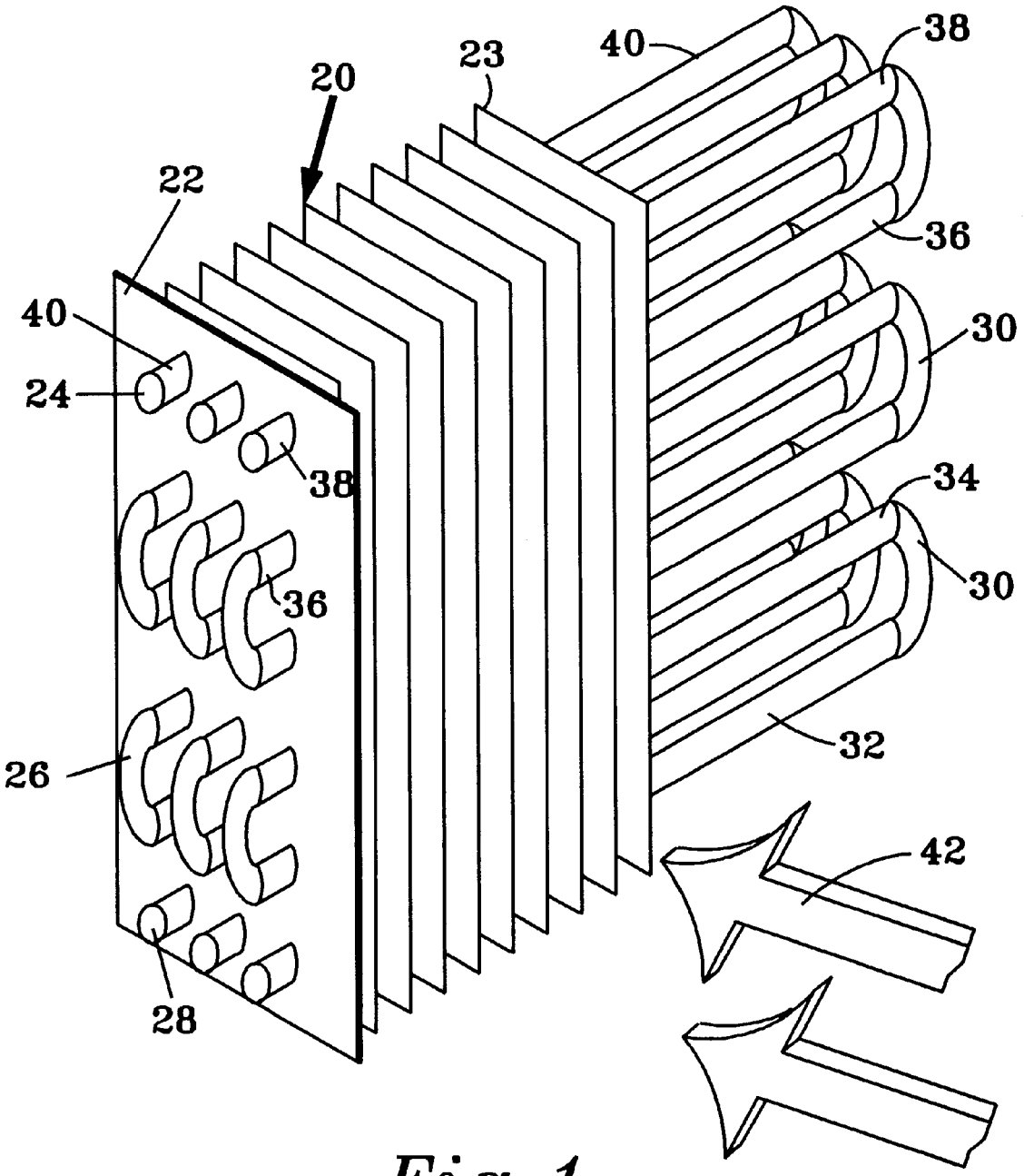
Fig. 1 PRIOR ART
FIG. 1 shows an isometric view, partly cut away, of a finned heat exchanger of the type to which the instant invention can be applied.

FIG. 1, labeled PRIOR ART, shows a typical refrigeration coil 20 in isometric view. Such a coil may be employed either as an evaporator, or as a condenser. In refrigeration systems, evaporators function as cooling coils and condensers as heating coils. Coil 20 has two end plates 22, (header sheets) one at each end of the coil, for supporting the coil tubing and for providing mounting means. In FIG. 1 only one end plate 22 is shown. Traversing the end plates are a matrix of tubes 32, 36, 38, 40 for carrying the evaporating (cooling) or condensing (heating) refrigerant. Each run of tube 32 is connected to another tube run 34 by a U-bend or return bend 30. While each return bend in FIG. 1 is shown connecting adjoining tube runs, other coil designs have return bends connecting tubes which are not adjacent. See, for example, FIGS. 2 A, B and 6 A, B.

While some heat transfer coils employed in refrigeration have no fins as shown at the distal end of the tubes in FIG. 1, most employ fins 23 to provide extended heat transfer surface, thereby increasing the amount of heat that a given group of tubes can transfer. The fins 23 are securely mounted to the refrigerant tubes 32, etc. In most cases the secure thermal connection between tubes and fins is made by expanding the tubes after they have been inserted into the group of adjacent fins (fin pack). Tube expansion is routinely performed by filling the coil with water and increasing the pressure to several thousand pounds per square inch (psi). In other applications the tubes are expanded by pushing or pulling an oversize mandril through the tube. In still other cases, the thermal bond is secured by dipping the coil into molten zinc or solder or even by furnace brazing in those applications where the coil is expected to be exposed to very high temperatures, such as those existing in furnace exhaust gasses.

Once all the tubes have been expanded into the fins, the fin-tube-header sheet becomes a rigid structure, in most cases capable of supporting itself from the two header sheets 22, 25 (FIGS. 2A, 2B) without sagging.

Heat Pipe

A heat pipe is a sealed tubular device containing a volatile liquid. In a typical application a straight heat pipe is tilted slightly, thereby providing a higher end and a lower end. By design the lower end will be exposed to a higher temperature and the higher end will be exposed to a cooler temperature. Under these conditions, the volatile liquid, residing by gravity in the lower end, vaporizes and the vapor flows toward the higher end. When the vapor reaches the cooler condition at the higher end it condenses. The liquid, resulting from the condensation, flows by gravity toward the lower end where the cycle is endlessly repeated, so long as the temperature difference between the higher end and the lower end is maintained. Some heat pipe designs include a porous material lining the interior of the heat pipe or, in some cases, even filling the heat pipe interior. The porous material acts like a wick and carries the volatile liquid from the cooler portion toward the warmer portion, even when the warmer portion is at the same level as, or even slightly higher than the cooler part. The vapor of the volatile liquid is not influenced by gravity and freely flows from the warmer end where it had been vaporized to the cooler end where it condenses.

Tests and experience have shown that heat pipes provide an even more effective way to conduct heat from a warmer to a cooler location than a bar of highly heat conductive metal such as a copper or silver having the same dimensions as the heat pipe.

The Present Invention

The invention employs heat pipes (secondary tubes) to allow fewer refrigerant carrying tubes (primary tubes) in a heat exchanger while simultaneously providing high or substantially undiminished heat transfer capacity. In a refrigeration system a heat exchanger employing fewer primary tubes needs less refrigerant charge for that heat exchanger and therefore for the refrigeration systems as a whole. While each heat pipe does contain a small amount of volatile liquid, which may itself be a refrigerant, the risk of significant refrigerant loss is sharply reduced since it is unlikely that the heat pipe tubes will have leaks simultaneously with the occurrence of leaks in the main system. Further, in addition to the invention allowing substantially fewer primary refrigerant carrying tubes for a coil of given heat transfer capacity, each primary tube employed requires substantially less refrigerant charge than the standard coil of FIG. 1 by virtue of the fact that in this invention substantially every primary tube has a large fraction of its volume occupied by the active portion of a heat pipe assembly.

Figure 2A:
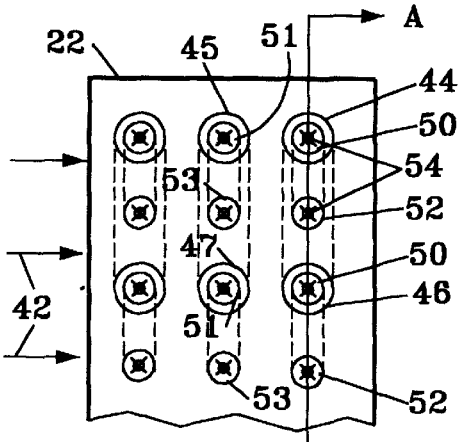
FIGS. 2A and 2B illustrate a finned coil similar to that shown in FIG. 1 within which a simple version of the invention including a U-shaped heat pipe is shown.
Figure 2B:
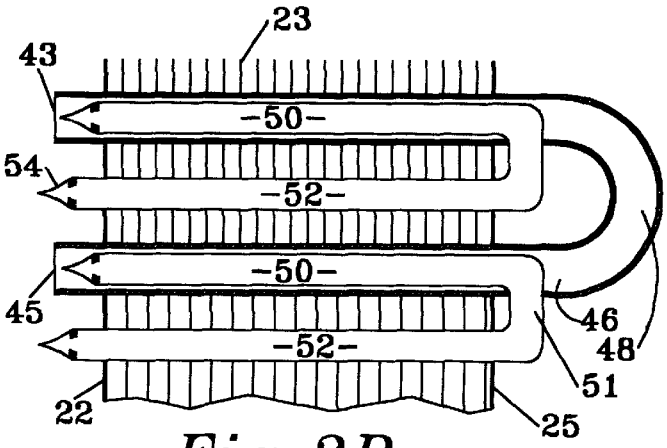

Now, referring to FIGS. 2A and 2B, there is shown in 2A an end view of a portion of a refrigerating coil employing the structure and principle of the invention with entering air flow direction shown at 42. The intended function of the FIG. 2 coil is as an evaporator or cooling coil. The coil has end plates 22 and 25 and fins 23 positioned substantially parallel to the end plates. Traversing the end plates and the fins are three rows of tubes (2A). Each row has two runs of primary larger tubes directly embedded in the fins 23 plus two runs of smaller secondary tubes 52 embedded in the fins 23. Primary tube 44 has an inlet end 43. Primary tube 46 has an outlet 45. The larger primary tubes 44 and 46 are joined at their distal ends by a U-connection 48. The U-connection 48 is also known as a U-bend or return bend. The inlets and outlets of the primary tubes may be interchanged according to the preferences of the design engineer.

Within each primary tube is embedded an active portion 50 of a heat pipe. A fin-embedded slave portion 52 of each heat pipe is connected to its active portion by a U-bend 51. Each heat pipe assembly, comprising an active run, a slave run and the U-bend, is charged with a volatile refrigerant such as propane, CFC 12 or some other volatile material. The charging procedure requires evacuation of the interior of the heat pipe to a high vacuum, then charging the interior with the correct amount of volatile liquid. The ends are then sealed by crimping and soldering or brazing.

Each slave portion 52 of each heat pipe assembly is positioned below its active portion 50. When cold refrigerant is introduced into an inlet 43 of the primary tube 44 it simultaneously cools both the fins 23 surrounding it and the active portion 50 of the heat pipe assembly. The cooling effect of the refrigerant on vapor of the volatile liquid within the heat pipe assembly causes the vapor to condense to a liquid. The liquid then flows out of the active section 50 of the heat pipe assembly and into the slave portion 52 of the heat pipe assembly.

The cooling function of the refrigerant flowing through the primary tube 44 on the fins and the air flowing through the cooling coil is achieved by partial evaporation of the refrigerant. The volatile liquid within the active heat pipe tube, which has been condensed from a vapor, by contact with the refrigerant flowing within the primary large tube 44, now flows by gravity into the lower, slave, portion 52 of the heat pipe assembly. That liquid now acts to cool the fins 23 surrounding the slave portion 52 of the heat pipe assembly and thereby acts to cool the air flowing through the coil. In the process of performing its cooling function, the volatile liquid within the lower slave portion 52 of the heat pipe is vaporized. The vapor resulting therefrom now flows counterflow to the liquid, back to the active portion 50 of the heat pipe assembly. The cycle is now endless repeated. So long as the primary refrigeration system operates. The vapor of the volatile liquid condenses within the upper active portion 50 of the heat pipe, flows through return bend 51 to the lower slave portion 52, is evaporated therein by the heat input from the warm air it is cooling via fins 23, and again flows back as a vapor to the active portion 50 of the heat pipe for recondensing.

The capacity of the heat pipe to transfer heat from the active portion 50 to the slave portion 52 is limited by potential interference between the liquid attempting to flow downward from the active section 50 to the slave section 52 and the vapor attempting to flow in the opposite direction.

Figure 3A:
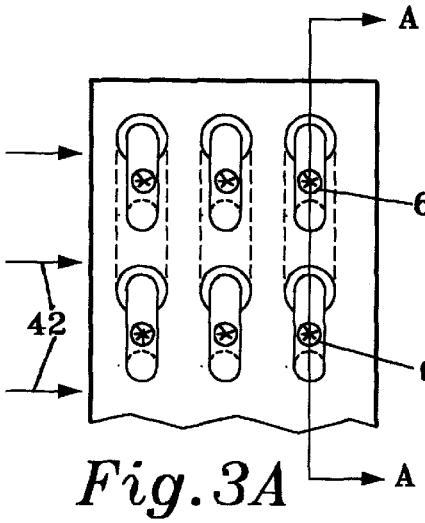
FIGS. 3A and 3B show a heat pipe formed in a continuous loop for improved output.
Figure 3B:
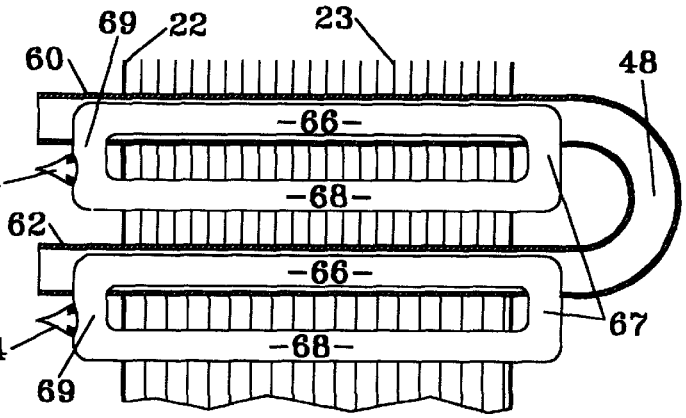

The structures of FIGS. 3A and 3B address this problem by providing a concurrent or parallel flow path for the liquid and vapor within the heat pipe. In FIG. 3B there is heat pipe active tube 66 embedded within upper refrigerant evaporator tube 60. The heat pipe active tube 66 is connected to heat pipe passive or slave tube 68 by a return bend at each end. The right hand ends of the active heat pipe tube 66 and the passive heat pipe tube 68 are connected together by return bend 67 and the left-hand ends of the active and passive heat pipe tubes are connected together by return bend 69. Typically the right-hand end of the coil assembly will be positioned slightly lower than the right-hand end during installation. In operation, when cold refrigerant is flowing through primary refrigerant tube 60 there will be, within the active heat pipe tube 66, a flow of condensed volatile liquid to the right toward return bend 67. This liquid will partly fill the lower, passive, heat pipe tube 68 and evaporate therein. The volatile vapor formed by the cooling effect of volatile liquid evaporating in the passive heat pipe tube 68, will flow leftward toward return bend 69, thereby establishing a uniform concurrent flow pattern. With this physical arrangement there is no possible interference between the vapor flow and the liquid flow since both are flowing in the same direction. Therefore, the heat transfer capability of this concurrent flow heat pipe assembly is very high. Naturally, either end of the coil can be the low end without prejudicing the heat pipe operation.

Continuing to refer to FIGS. 3A and B, the volatile liquid from the upper primary refrigerant tube 60, flows via return bend 48 to the lower primary refrigerant tube 62. The heat pipe assembly associated with the lower primary refrigerant tube 62 is identical to and perform the same as described above for the heat pipe assembly associated with primary refrigerant tube 60. At the left end of the heat pipe assembly, positioned on return bend 69 there is a tap or access port 64 for providing the initial evacuation and charging operation of the heat pipe assembly. Following this charging operation the port 64 is sealed by soldering or brazing.

While the primary refrigerant circulating within the large tubes 44, 46, 60 and 62 has been described as being the volatile type, the coil designs described function just as well, regardless of the refrigerant type employed. Chilled water or brine is widely employed in very large refrigerating and air-conditioning systems and heat pump systems both for cooling the cooling coils and for rejecting heat to the heating or heat rejection coils. The heat exchange coils described herein have substantially the same advantages, when employed with water or brines as the primary coolant, as when employed with volatile refrigerants.

While the heat exchange coils shown in FIGS. 4A and 4B and 5A and 5B are structurally the same as the heat exchange coils described in FIGS. 3A and B and 4A and B, they are positioned to function correctly as condensers or heating coils rather than evaporators or cooling coils. For this purpose, in these FIGS. 4 and 5, the active heat pipe tubes are positioned beneath the passive heat pipe tubes. Since the condenser function rejects heat from the refrigerant to the air, the air acts to cool both the primary and the secondary tubes.

Referring now to FIG. 3B, the cooling effect of the air stream 42 causes refrigerant vapor to condense to a liquid in both the primary refrigerant tube 46 and the slave portion 52 of the heat pipe. The liquid, resulting from condensation in slave heat pipe portion 52, now flows through return bend 51 to the lower active heat pipe tube 50. There it is vaporized by the hot condensing refrigerant, thereby cooling and condensing the hot refrigerant to a liquid in a manner substantially equivalent to the cooling effect of the fins 23 on primary refrigerant tube 46 on the same refrigerant flowing therein.

The liquid phase of the volatile liquid within the heat pipe assembly, which has formed through condensation within the upper heat pipe slave tube 52, now flows to the lower active heat pipe tube 50 through return bend 51. During this downward flow the liquid travels countercurrent to the vapor flowing from the active heat pipe tube 50 to the slave heat pipe tube 52. As explained above, this countercurrent flow condition limits the heat transfer capacity of the heat pipe.

In FIGS. 5A and B, this condition is overcome in a manner analogous to that described in connection with the structure of FIGS. 3A and B. In FIG. 5B the right-hand coil end with header sheet 23 is positioned lower than the left-hand end having header 22. Volatile liquid resulting from condensation in the upper slave portion 68 of the heat pipe assembly runs by gravity to return bend 67 and thence into the lower active tube 66 of the heat pipe assembly. Where it is again vaporized, thereby cooling the primary refrigerant flowing through the annular space between the large outer tube 62 and the smaller active portion 66 of the heat pipe assembly. The vapor, formed within the active heat pipe tube 66, now flows to the upper slave heat pipe tube 68 via return bend 69. This flow path preserves concurrent flow within the heat pipe assembly and provides thereby a substantially higher heat transfer capacity that can be achieved in the two ended heat pipe structure of FIGS. 4A and B.

Referring now to FIGS. 6A and 6B there is shown a construction where several slave heat pipe runs are employed with one active heat pipe run. In FIG. 6B, shown in an evaporating or cooling mode, there is a single active heat pipe section 86 positioned within a primary tube 80 through which a primary coolant circulates. There is shown not one passive or slave section, as shown and described in FIGS. 2 and 3, but two slave sections 88 and 90. These are connected seriatim so that liquid volatile liquid formed within the active heat pipe tube 86 must flow through slave tube 88 to reach slave tube 90. So long as the heat transfer loads are small, this is an effective and economical construction. The primary application for this design is in short coils or coils that have a small temperature difference between the refrigerant and the warm air 42 to be cooled. Since the structure of FIG. 6 is clearly counterflow within the heat pipe assembly, the capacity of the heat pipe to transfer heat is limited. However, within its limitations, best determined by test, such a multiple slave tube arrangement can be highly effective.

In FIG. 7A and 7B, the counterflow problem is solved by employing an odd number of slave or passive heat pipe tubes for each active heat pipe tube. In FIG. 7B there is shown primary refrigerant tube 100 having positioned within, the active section 104 of the heat pipe assembly. There are provided three passive or slave heat pipe runs 110, 108 and 106. These are connected in series by return bends 107 and 111 as well as an intermediate unnumbered return bend joining heat pipe tube 110 and 108. However, the non-U-bend ends of the active heat pipe tube 104 and the non-U-bend end of passive heat pipe run 106 are connected by long return bend 108. In this heat pipe arrangement there is established concurrent flow for the liquid volatile fluid within the heat pipe assembly so that even with relatively high heat loads and relatively long coils only a few primary refrigerant containing tubes 100 etc. are required to satisfy the required heat transfer in a large coil.

Figure 8:
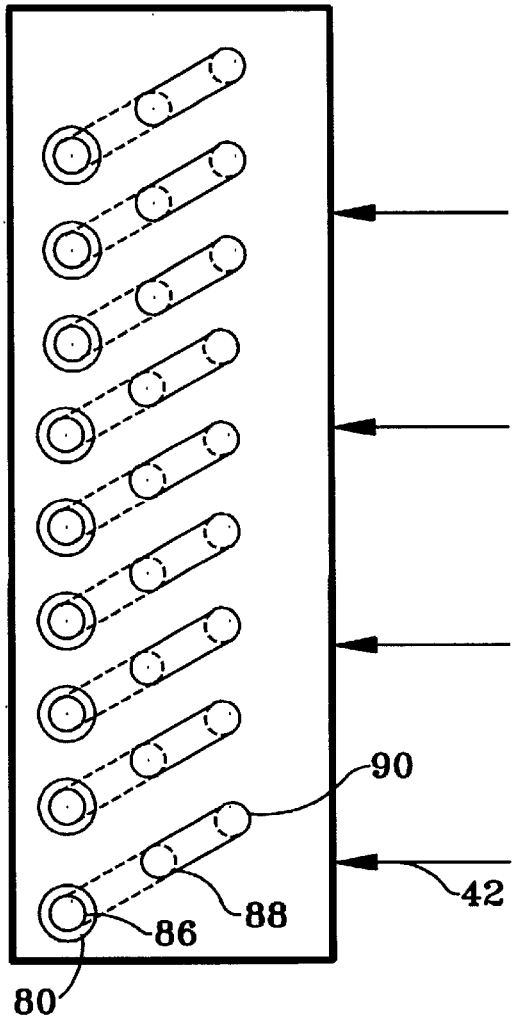
FIGS. 8 and 9 illustrate the passive heat pipe tubes positional in the entering airstream.

In FIG. 8 there is shown a heating arrangement having a row of primary tubes 80 in the discharge air stream. This is the tube position in the coil which is affected by the air which has traversed substantially every other part of the coil before reaching it. Since the primary refrigerant carrying tubes have the coldest temperatures, they are positioned in the leaving airstream of the coil to provide the last best cooling effect. The active heat pipe section 86 is positioned within this primary tube 80. Slave or passive heat pipe tubes 88 and 90 are connected to the active tube as described and illustrated elsewhere. In the cooling arrangement the passive or slave heat pipe tubes are positioned higher than the active heat pipe tube. In the construction of FIG. 8, also, the passive heat pipe tubes are positioned in the entering airstream while the primary cooling tube and its active counterpart are positioned in the leaving airstream.

Figure 9:
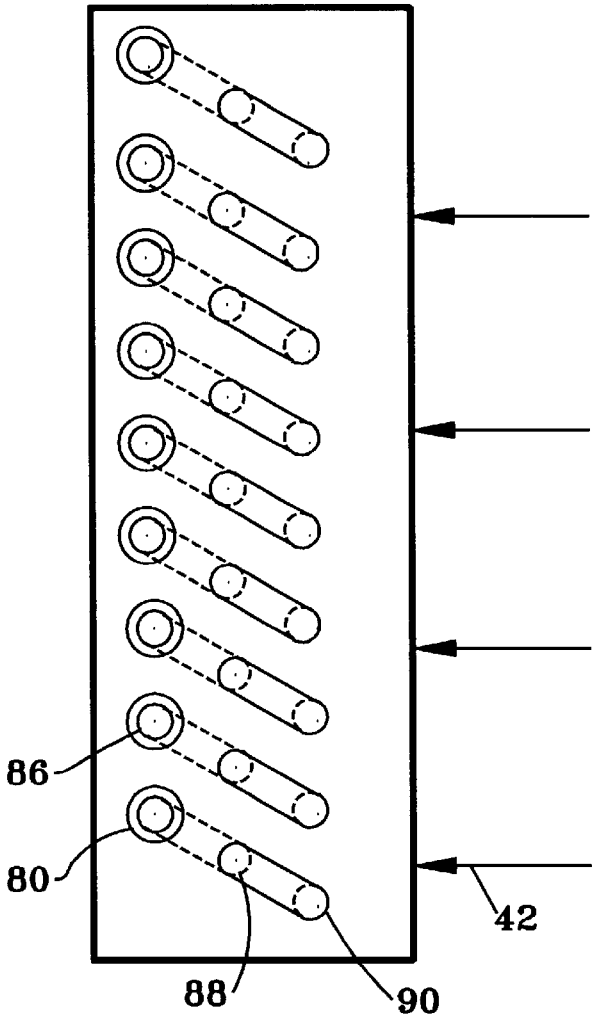

In like manner, in FIG. 9 there is shown a heating coil or condenser where the passive tubes 88 and 90 are also positioned in the entering airstream but lower than the active heat pipe tube 86, while the primary refrigerant tube and its active heat pipe counterpart 80 positioned within, is located in the coil discharge airstream.

From the foregoing description, it can be seen that the present invention comprises an advanced design for a heat exchange coil which sharply reduce the quantity of leakable refrigerant required for the coil and provided other significant advantages. It will be appreciated by those skilled in the art that changes could be made to the embodiments described in the foregoing description without departing from the broad inventive concept thereof. It is understood, therefore, that this invention is not limited to the particular embodiment or embodiments disclosed, but is intended to cover all modifications of the disclosed construction and of its elements and equivalents thereof which are within the scope and spirit of the invention as defined by the appended claims.

I claim:

1. Heat transfer coil means for cooling or heating a secondary fluid contacting its exterior, the coil having a matrix of substantially parallel primary tubes through the interior of which a primary heat transfer fluid is circulated, a heat pipe comprising a sealed tube containing a volatile liquid, the sealed tube having a length, a first portion of the length of said heat pipe being positioned within a length of the primary tube and a second portion of that heat pipe length being positioned outside the primary tube and substantially parallel with it, whereby the secondary fluid exchanges heat both with the primary tube and with the second portion of the heat pipe thereby also exhanging heat with the primary fluid.

2. Heat transfer coil means as recited in claim 1 further providing an array of substantially parallel fins having a plane substantially perpendicular to each of the primary tubes and positioned so that both the primary tube and the second portion of the heat pipe tube traverses the fin array thereby providing an extended surface for facilitating heat transfer between the secondary fluid and the primary tube and the second portion of the heat pipe.

3. Heat transfer coil means as recited in claim 2 further providing that the heat pipe has two closed ends, one closed end residing within the primary tube.

4. Heat transfer coil means as recited in claim 3 further providing that the portion of the heat pipe residing outside the primary tube is formed into a series of parallel runs.

5. Heat transfer coil means as recited in claim 1 further providing that the heat pipe comprises a closed loop having parallel runs and having a first run residing within the primary tube.

6. Heat transfer coil means as recited in claim 5 further providing that a second heat pipe run resides outside the primary tube.

7. Heat transfer coil means as recited in claim 6 further providing an array of substantially parallel fins having a plane substantially perpendicular to each of the primary tubes and positioned so that both the primary tubes and the heat pipe tubes traverse the fin array whereby the fins provide an extended surface for facilitating heat transfer between the secondary and the primary fluids.

8. Heat transfer means as recited in claim 7 further providing that the portion of the heat pipe residing outside the primary tube is formed into a series of parallel runs.

* * * * *